US011229273B2

(12) United States Patent
Holbert

(10) Patent No.: US 11,229,273 B2
(45) Date of Patent: Jan. 25, 2022

(54) FRICTIONAL ANTI-ROTATION DEVICE FOR LIP BALM DISPENSER

(71) Applicant: J-WOOD COSMETICS LLC, Mechanicsburg, PA (US)

(72) Inventor: Jacob George Holbert, Mechanicsburg, PA (US)

( * ) Notice: Subject to any disclaimer, the term of this patent is extended or adjusted under 35 U.S.C. 154(b) by 0 days.

(21) Appl. No.: 16/939,261

(22) Filed: Jul. 27, 2020

(65) Prior Publication Data

US 2021/0030138 A1 Feb. 4, 2021

Related U.S. Application Data

(60) Provisional application No. 62/881,991, filed on Aug. 2, 2019.

(51) Int. Cl.
*A45D 40/00* (2006.01)
*A45D 40/12* (2006.01)
*A45D 40/06* (2006.01)

(52) U.S. Cl.
CPC ..... *A45D 40/12* (2013.01); *A45D 40/06* (2013.01); *A45D 40/065* (2013.01); *A45D 2040/0025* (2013.01)

(58) Field of Classification Search
CPC ..... A45D 40/06; A45D 40/065; A45D 40/12; A45D 2040/0025
See application file for complete search history.

(56) References Cited

U.S. PATENT DOCUMENTS

| | | | | |
|---|---|---|---|---|
| 3,623,821 A * | 11/1971 | Gould | A45D 40/16 401/86 |
| 4,738,559 A * | 4/1988 | Gueret | A45D 40/06 401/68 |
| 8,414,209 B2 * | 4/2013 | Forrey | A45D 40/12 401/52 |
| 10,524,557 B1 * | 1/2020 | McDaniel | A45D 40/12 |
| 2021/0093071 A1 * | 4/2021 | Koch | A45D 40/12 |

* cited by examiner

*Primary Examiner* — Jennifer C Chiang

(74) *Attorney, Agent, or Firm* — Spilman Thomas & Battle, PLLC

(57) ABSTRACT

A cap for a tubular balm dispenser is disclosed. The cap includes a base portion and a sidewall. The sidewall extends perpendicularly from the base portion and defines a recess for receiving a tubular balm dispenser. The cap is open at one end opposite the base portion. The cap is formed from an elastomeric material. The sidewall has an inner sidewall surface removably attachable to the dispenser and configured to resist rotation of the tubular balm dispenser relative to the cap; wherein the elastomeric material provides a friction between the tubular balm dispenser and the cap when the tubular balm dispenser is inserted into the recess and seated against the base portion.

16 Claims, 4 Drawing Sheets

FRICTIONAL ANTI-ROTATION DEVICE FOR LIP BALM DISPENSER

CROSS-REFERENCE TO RELATED APPLICATIONS

This application claims priority to, and the benefit of U.S. Provisional Patent Application Ser. No. 62/881,991 filed Aug. 2, 2019, entitled "Frictional Anti-Rotation Device For Lip Balm Dispenser", which is hereby incorporated by reference.

BACKGROUND OF THE INVENTION

The application generally relates to a frictional anti-rotation device. The application relates more specifically to a frictional anti-rotation cap that is placed onto lip balm tube dispensers to prevent accidentally twisting the lip balm tube's rotary actuation collar.

Lip balm is a therapeutic product that is used to heal and protect a user's lips. Lip balm may be distributed in various packages, however, one of the most ubiquitous and convenient form factor is the standard tube. Tubes of lip balm may be stored in a purse or pocket while not in use. Additionally, these lip balm tubes are traditionally equipped with a rotary collar that enables users to discharge an amount of the lip balm contained therein. While the rotary collar provides access to the lip balm, it may also be inconvenient when the lip balm is accidentally dispensed while inside a purse or pocket of a user. When disposed within a purse or pocket, the lip balm tube may be jostled and the movement sufficient to rotate the collar, thus discharging the lip balm unintentionally and causing it to get stuck in the lid, dispensing it in the pocket or purse and ruining the lip balm. As a result, the lip balm creates a mess when dispensed in a the purse or pocket.

An objective of the present invention is to address this issue by providing a friction inducing cap that prevents the rotary actuation collar from twisting while in a user's purse or pocket. The present invention is a flexible and elastic cap that slides over a lip balm tube's rotary actuation collar. Once attached to the lip balm tube the present invention increases the amount of force required to twist the rotary actuation collar; thus preventing accidental discharge. The present invention increases the force required to twist the rotary actuation collar without impeding the user's ability to dispense desired amounts of lip balm at will.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

One embodiment relates to a cap for a tubular balm dispenser. The cap includes a base portion and a sidewall. The sidewall extends perpendicularly from the base portion and defines a recess for receiving a tubular balm dispenser. The cap is open at one end opposite the base portion. The cap is formed from an elastomeric material. The sidewall has an inner sidewall surface removably attachable to the dispenser and configured to resist rotation of the tubular balm dispenser relative to the cap; wherein the elastomeric material provides a friction between the tubular balm dispenser and the cap when the tubular balm dispenser is inserted into the recess and seated against the base portion.

Another embodiment relates to a tubular lip balm dispenser comprising: a hollow cylinder closed at a first end and having an open second end opposite the first end; an external wall; a contents; and a rotary drive member extending axially through the hollow cylinder, the drive member configured to force the contents from the second end of the hollow tube portion; a disk portion disposed at a first end of the rotary drive member adjacent the first end; the drive member configured to transfer a rotational movement of drive member to a linear displacement of the contents; the disk portion is fixedly connected to drive member and rotatable to turn the drive member; and a cap comprising: a base portion and a sidewall, the sidewall extending perpendicularly from base portion defining a recess for receiving a tubular balm dispenser; the cap open at an end opposite the base portion; the cap formed of an elastomeric material; the sidewall wherein an inner sidewall surface configured to resist rotation of the tubular balm dispenser relative to the cap; wherein the elastomeric material provides a friction between the tubular balm dispenser and the cap when the tubular balm dispenser is inserted into the recess and seated against the base portion All illustrations of the drawings are for the purpose of describing selected versions of the present invention and are not intended to limit the scope of the present invention.

An advantage of the invention is a cap insertable over a lip balm dispensing tube that prevents the accidental twisting of a rotary actuation collar found in traditional lip balm tubes.

Another advantage of the present invention is to provide a flexible cap that prevents the accidental discharge of lip balm from a tube.

Another advantage is the ability to insert the actuation collar of a standard lip balm dispensing tube into the cap.

Still another advantage is that the cap sleeve slides over the end of the inserted lip balm tube and increases the friction required to twist the rotary actuation collar. More specifically, inserting the rotary actuation collar of a tube of lip balm through the sleeve and into the tube receptacle increases the friction required to twist the rotary actuation collar, such that the lip balm tube is prevented from accidentally discharging stored lip balm.

Yet another advantage is that, while accidental discharge is prevented, the present invention does not impede a user's ability to twist the rotary actuation collar of the lip balm tube while inserted into the twist eliminating lip balm cap.

Another advantage is a tapered end of the tube that is configured to increase the friction between the twist eliminating lip balm cap and the exterior surface of the lip balm tube. The tapered end prevents the inserted lip balm tube from accidentally sliding out of the sleeve. An adhesive may be used to secure the cap on the lip balm tube which ensures the lip balm does not slide out of the sleeve.

Embodiments of the present invention are constructed from flexible materials including, but not limited to, rubber, nylon, and plastic.

Alternative exemplary embodiments relate to other features and combinations of features as may be generally recited in the claims.

BRIEF DESCRIPTION OF DRAWINGS

The application will become more fully understood from the following detailed description, taken in conjunction with the accompanying figures, wherein like reference numerals refer to like elements, in which.

DETAILED DESCRIPTION OF INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
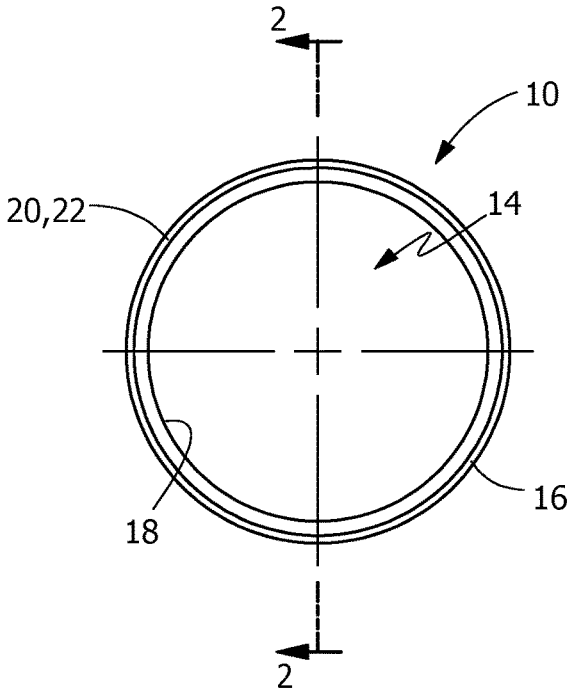
FIG. 1 shows a plan view of an frictional anti-rotation cap (FAC) device of the present invention.
Figure 2:
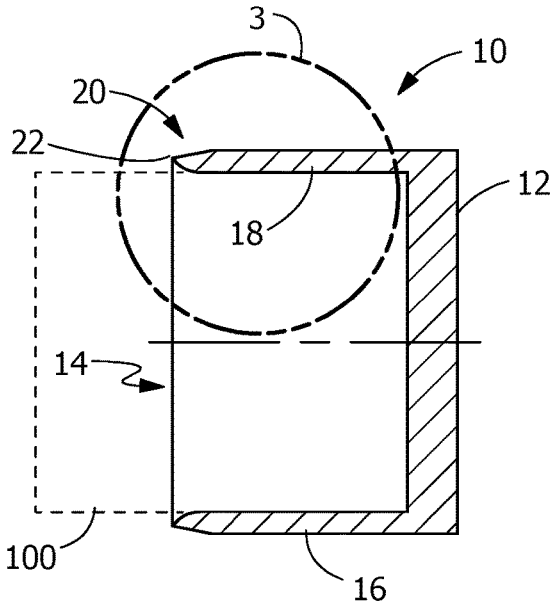
FIG. 2 shows a cross-sectional view of the FAC of FIG. 1, taken along the lines 2-2.
Figure 3:
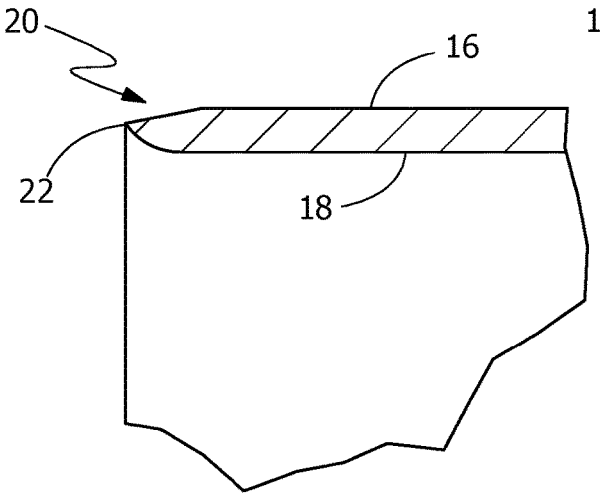
FIG. 3 shows a detail of the rounded edge on the FAC shown in FIG. 2, indicated by dotted line A.
Figure 4:
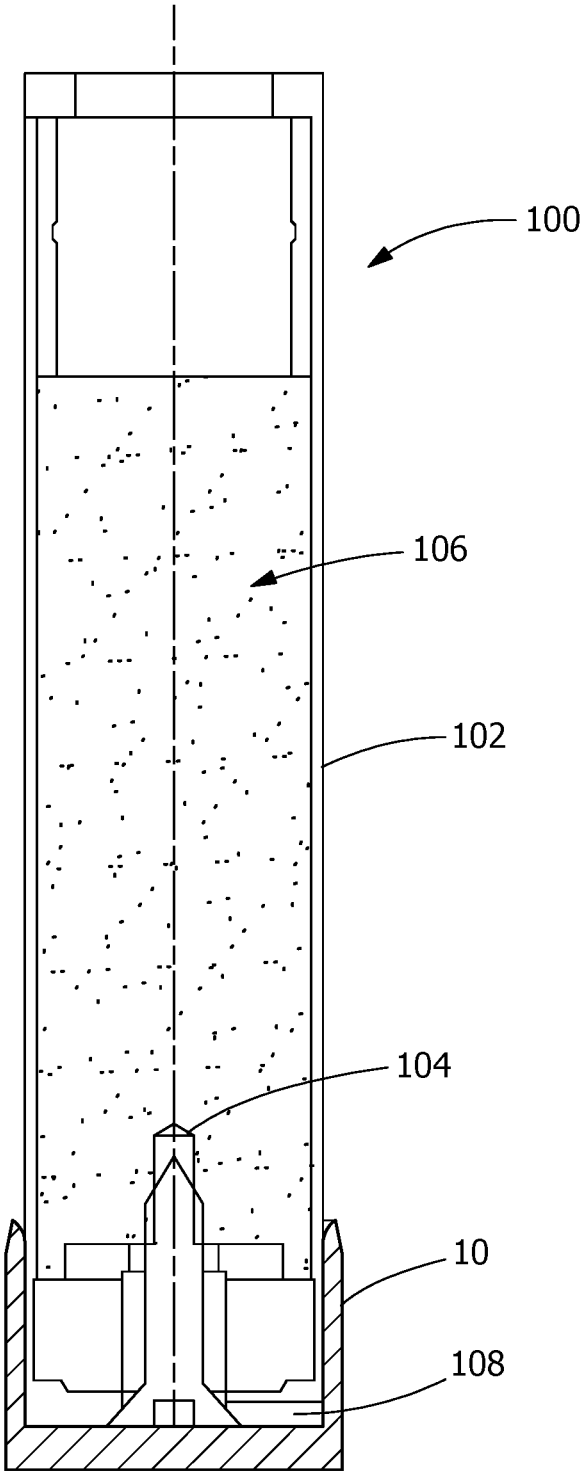
FIG. 4 shows an exemplary lip balm dispenser tube for use with the FAC of the present invention.
Figure 5:
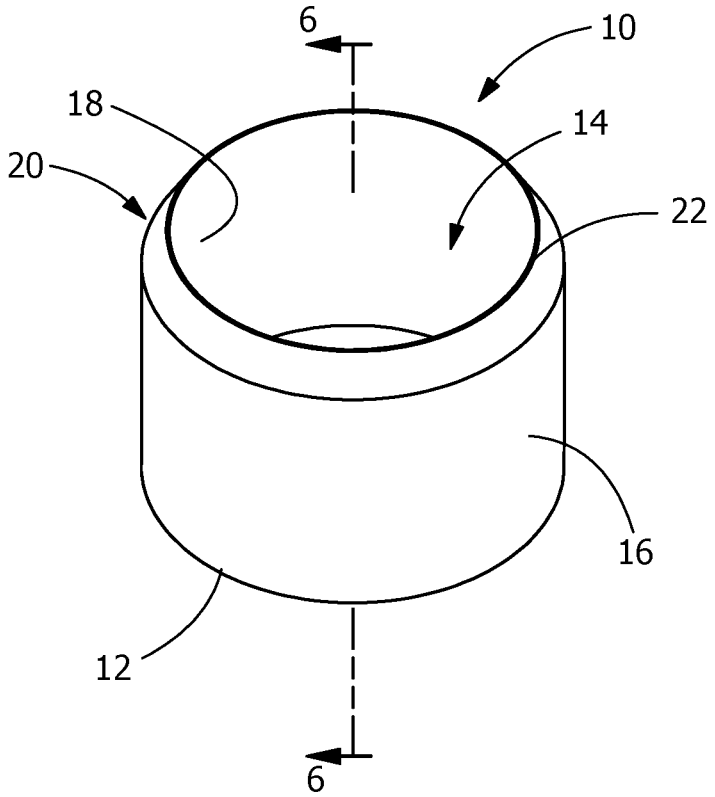
FIG. 5 shows a perspective view of an exemplary embodiment of the FAC.
Figure 6:
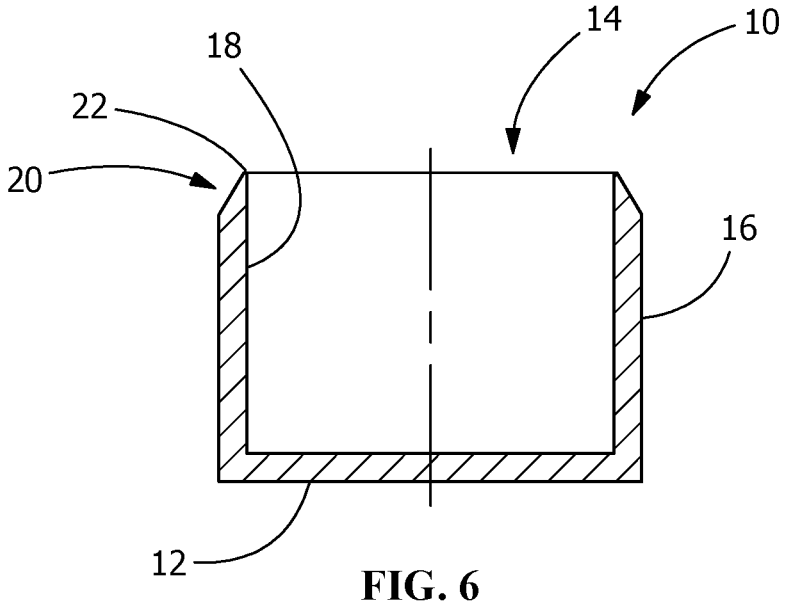
FIG. 6 shows a sectional view of the FAC of FIG. 5, taken along lines B-B.

Referring to FIGS. 1-3 a FAC 10 is a generally cylindrical, hollow-shaped receptacle or cap for retentively receiving a tubular lip-balm dispenser (FIG. 4). FAC 10 has a base portion 12 opposite an open end indicated by arrow 14, and a sidewall 16 extending from base portion 12 to open end 14 of the cylindrical FAC 10. In an embodiment FAC 10 is made of an elastomeric material to allow an inner surface 18 of sidewall 16 to grip tube portion 100 along an external wall 102 (FIG. 4), thus resisting rotation of tube portion 100 relative to FAC 10. Friction between wall 102 and FAC 10 is provided by the elastomeric property of FAC 10. Sidewall 16 include a tapered portion 22 at a distal end 20 along a circular periphery of sidewall 16. The base may be a flat platform that enables FAC 10 and tube portion 100 to rest on top of level surfaces such as a table or desk.

As shown in FIG. 4, a prior art tube dispenser for lip balm includes a hollow tube portion 100 defined by external wall 102, and a rotary drive member 104 extending axially through tube 100 for forcing the contents 106, e.g., lip balm or similar emulsion or gelatinous substance from the discharge end of hollow tube portion 100. A collar or disk portion 108 on one end of rotary drive member 104 is disposed adjacent a closed end of tube portion 100. Drive member may be, e.g., a helical or threaded rod to transfer rotational movement of drive member 104 to linear displacement of lip balm 106. Disk portion 108 is fixedly connected to drive member 104 and extends from tube portion 100. Disk portion 108 is connected to tube portion and rotatable to turn drive member 104. Disk portion may include notched, serrated or knurled edges for gripping.

In an embodiment, FAC 10 is positionable over disk portion 108 with sidewall 16 is frictionally engaged with at least a portion of wall 102. When placed over disk portion 108, disk portion 108 is restricted from rotating in any direction. In order for lip balm to advance within tube portion 100, FAC 10 must be removed, or additional torque applied sufficient to overcome the resistive frictional force created by FAC 10.

Referring next to FIGS. 2 and 3, in one exemplary embodiment, tapered portion 22 at a distal end 20 along a circular periphery of sidewall 16. Tapered portion 22 provides a slightly enlarged diameter opening at the distal end of FAC 10, to allow disk, or collar, portion 108 to fit into FAC 10 more easily, and to maintain a frictional contact with wall 102 when disk portion 108 is seated against base portion 102.

Figure 7:
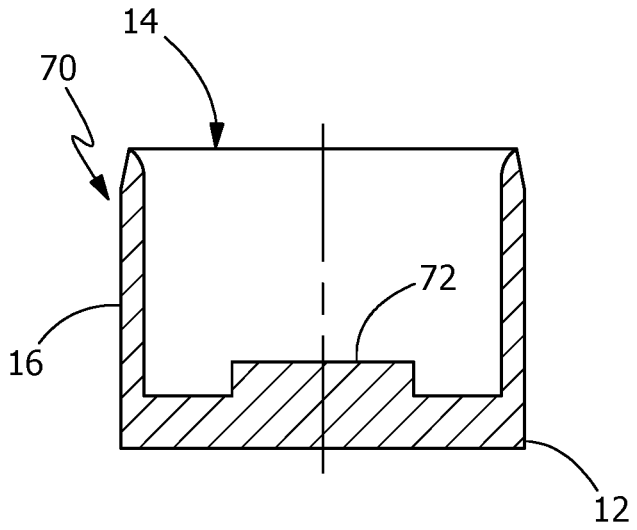
FIG. 7 shows an alternate embodiment of an FAC taken along lines X-X in FIG. 8.
Figure 8:
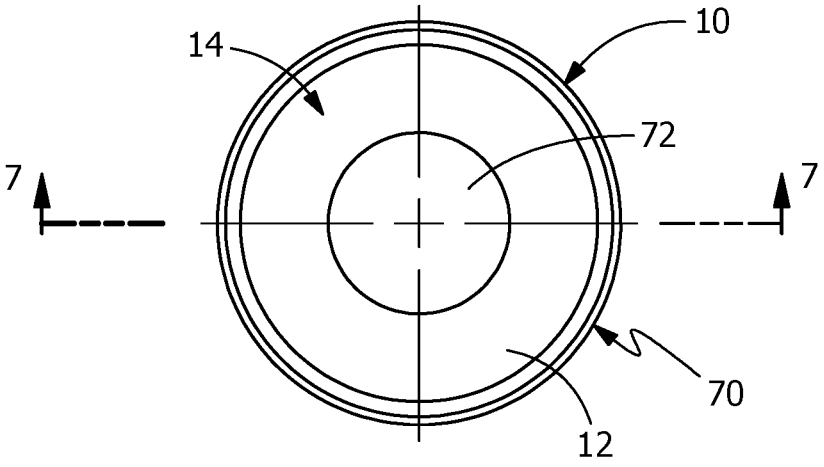
FIG. 8 shows a plan view of the FAC of FIG. 7.

Referring next to FIGS. 7 & 8, an alternate embodiment of an FAC 10 is shown. FIG. 7 is a cross-sectional view of the FAC 70 taken along lines 7-7 in FIG. 8. FAC 70 also has a base portion 12 opposite an open end indicated by arrow 14, and a sidewall 16 extending from base portion 12 to open end 14 of the cylindrical FAC 70. The FAC 70 is modified to include a raised cylindrical section 72 in the bottom center of base portion 12, which in turn decreases the amount of adhesive needed to secure the cap onto the tube 100. Additionally, raised cylindrical section 72 resists unintentional rotation of the disk portion 108 by providing additional frictional contact with disk portion 108.

In one embodiment FAC 10 is a device that prevents the accidental twisting or rotation of the actuation collar found in traditional lip balm tubes. The present invention comprises a base, a sleeve or sidewall, a tapered end, and a tube receptacle. It is an aim of the present invention to provide a flexible cap that prevents the accidental discharge of lip balm from a tube. This is accomplished by inserting the actuation collar of a lip balm tube into FAC 10. FAC 10 slides over the end of the inserted lip balm tube and is configured to increase the friction required to twist the rotary actuation collar. More specifically, inserting the rotary actuation collar of a tube of lip balm through the sleeve and into the tube receptacle increases the friction required to twist the rotary actuation collar, such that the lip balm tube is prevented from accidentally discharging stored lip balm. While accidental discharge is prevented, the present invention does not impede a user's ability to twist the rotary actuation collar of the lip balm tube while inserted into the twist eliminating lip balm cap, when deliberate torque or pressure is manually applied by the user.

In another embodiment of the present invention, the base is a flat platform that enables the present invention to rest on top of level surfaces. It is an aim of the present invention to provide a base that is connected to one end of the sleeve. The sleeve is a flexible tube that is used to encompass the lateral edge of a lip balm tube. the tapered end of the tube is designed to increase the friction between the twist eliminating lip balm cap and the exterior surface of the lip balm tube. In the preferred embodiment of the present invention the tapered end is the open end of the sleeve that is positioned opposite the base. The tapered end is used to prevent the inserted lip balm tube from accidentally sliding out of the sleeve. The tube receptacle is a receptacle within the sleeve into which the rotary actuation collar is inserted. The twist eliminating lip balm cap is preferably made of thermoplastic elastomer. Embodiment of the present invention are constructed from flexible materials including, but not limited to, rubber, nylon, and plastic.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the frictional anti-rotation cap, as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

What is claimed is:

1. A cap for a tubular balm dispenser comprising:

a base portion and a sidewall arranged in a cylindrical shape, the sidewall extending perpendicularly from base portion defining a recess for receiving a tubular balm dispenser; the cap open at an end opposite the base portion; the cap formed of an elastomeric material for gripping an outer surface of the tube balm dispenser;

the sidewall having a tapered portion at a distal end along a circular periphery of the sidewall;

wherein an inner sidewall surface is positioned to resist rotation of the tubular balm dispenser relative to the cap;

wherein the elastomeric material provides a friction between the tubular balm dispenser and the cap when the tubular balm dispenser is inserted into the recess and seated against the base portion;

wherein the tubular lip balm dispenser comprises a hollow tube portion defined by an external wall, a rotary drive member extending axially through the tubular lip balm dispenser, and contents within the tubular dispenser; the rotary drive member positioned to force the contents from the discharge end of hollow tube portion.

2. The cap of claim 1, wherein the tubular lip balm dispenser further comprises:

a disk portion disposed at a first end of the rotary drive member adjacent a closed end of a tube portion of the lip balm dispenser.

3. The cap of claim 1, wherein the drive member comprises one of a helical or threaded rod, the drive member positioned to transfer a rotational movement of drive member to a linear displacement of the contents.

4. The cap of claim 1, wherein the disk portion is fixedly connected to drive member and extends from the tube portion; and the disk portion is connected to the tube portion, the disk portion rotatable to turn drive member.

5. The cap of claim 1, wherein the contents comprises one of a lip balm, an emulsion or a gelatinous substance.

6. The cap of claim 1, wherein the cap is positionable over disk portion.

7. The cap of claim 1, wherein the sidewall is frictionally engaged with at least a portion of the wall.

8. The cap of claim 1, wherein, when the cap is placed over the disk portion, disk portion is restricted from rotating in any direction.

9. The cap of claim 1, wherein, to advance the contents within the tube portion the cap must be removed or sufficient additional torque must be applied to the cap to overcome a resistive frictional force created by the cap in contact with the tube portion.

10. The cap of claim 1, wherein a tapered portion is disposed at a distal end along a circular periphery of the sidewall and wherein the tapered portion comprises an enlarged diameter opening slightly larger than an outside diameter of the wall at the distal end of the cap to allow the disk or collar portion to fit into the cap and to maintain a frictional contact with wall when the disk portion is seated against the base portion.

11. The cap of claim 1, wherein the base portion of the cap has an interior surface comprising a raised, circular edge situated centrally on the interior surface; the raised, circular edge being sufficiently smaller in diameter than a disk portion disposed distally from the cap of a tubular lip balm dispenser so as to maintain a frictional connection with the disk portion when the cap is seated against the disk portion.

12. The cap of claim 1 having a base portion of the cap with an interior surface having a raised, circular edge situated centrally on the interior surface, wherein the raised, circular edge on the interior surface of the cap includes a frictional connection with an interior edge of a disk portion of the tubular lip balm dispenser when the cap is seated against the disk portion; said frictional connection allowing the disk portion to be rotatably moved in a designated direction by twisting the cap in the designated direction while the cap is seated against the disk portion.

13. A tubular lip balm dispenser comprising:

a hollow cylinder closed at a first end and having an open second end opposite the first end; an external wall; a contents; and a rotary drive member extending axially through the hollow cylinder, the drive member positioned to force the contents from the second end of the hollow tube portion;

a disk portion disposed at a first end of the rotary drive member adjacent the first end; the drive member positioned to transfer a rotational movement of drive member to a linear displacement of the contents; the disk portion is fixedly connected to drive member and rotatable to turn the drive member;

and a cap comprising:

a base portion and a sidewall arranged in a cylindrical shape, the sidewall extending perpendicularly from base portion defining a recess for receiving a tubular balm dispenser; the cap open at an end opposite the base portion; the cap formed of an elastomeric material for gripping an outer surface of the tube balm dispenser;

the sidewall having a tapered portion at a distal end along a circular periphery of the sidewall;

wherein an inner sidewall surface is positioned to resist rotation of the tubular balm dispenser relative to the cap;

wherein the elastomeric material provides a friction between the tubular balm dispenser and the cap when the tubular balm dispenser is inserted into the recess and seated against the base portion.

14. The dispenser of claim 13, wherein the disk portion may include a frictional connection with an interior edge of a disk portion of the tubular lip balm dispenser when the cap is seated against the disk portion for gripping.

15. The dispenser of claim 13, wherein the contents comprises one of a balm, an emulsion or a gelatinous substance.

16. The dispenser of claim 13, wherein the drive member comprises a helical or threaded rod.

* * * * *